US009404643B2

(12) United States Patent
Clark

(10) Patent No.: US 9,404,643 B2
(45) Date of Patent: Aug. 2, 2016

(54) ONE PIECE LED MODULE WITH ROTATABLE FACE

(71) Applicant: Juno Manufacturing LLC, Des Plaines, IL (US)

(72) Inventor: Stephen Howard Clark, Downers Grove, IL (US)

(73) Assignee: Acuity Brands Lighting, Inc., Atlanta, GA (US)

( * ) Notice: Subject to any disclaimer, the term of this patent is extended or adjusted under 35 U.S.C. 154(b) by 0 days.

(21) Appl. No.: 14/605,511

(22) Filed: Jan. 26, 2015

(65) Prior Publication Data

US 2015/0219296 A1 Aug. 6, 2015

Related U.S. Application Data

(60) Provisional application No. 61/934,966, filed on Feb. 3, 2014.

(51) Int. Cl.

| | |
|---|---|
| ***F21V 21/30*** | (2006.01) |
| ***F21S 8/02*** | (2006.01) |
| ***F21V 17/16*** | (2006.01) |
| ***F21V 21/04*** | (2006.01) |
| ***F21V 29/503*** | (2015.01) |
| *F21Y 101/02* | (2006.01) |

(52) U.S. Cl.

CPC ..... *F21V 21/30* (2013.01); *F21S 8/026* (2013.01); *F21V 17/164* (2013.01); *F21V 21/04* (2013.01); *F21V 29/503* (2015.01); *F21Y 2101/02* (2013.01); *Y10T 29/49947* (2015.01)

(58) Field of Classification Search

CPC ..... F21V 21/02; F21V 21/04; F21V 21/14; F21V 21/18; F21V 21/21; F21V 21/30; F21V 29/503; F21V 29/713; F21V 29/74; F21V 29/75; F21V 29/22; F21V 29/2206; F21V 29/2212; F21S 8/02; F21S 8/022; F21S 8/024; F21S 8/026; F21Y 2101/02

USPC ..... 362/249.01, 249.02, 249.07, 269, 285, 362/287, 288, 294, 364, 365, 373, 402

See application file for complete search history.

(56) References Cited

U.S. PATENT DOCUMENTS

| | | | | |
|---|---|---|---|---|
| 4,356,540 | A * | 10/1982 | Goralnik | F21S 8/04 362/147 |
| 6,632,006 | B1 * | 10/2003 | Rippel | F21S 8/02 362/147 |
| 6,655,813 | B1 * | 12/2003 | Ng | F21S 8/02 362/147 |
| 7,654,705 | B2 * | 2/2010 | Czech | F21S 8/02 362/147 |
| 8,096,670 | B2 * | 1/2012 | Trott | F21S 8/02 362/147 |
| 8,348,479 | B2 | 1/2013 | Tickner et al. | |
| 8,403,533 | B1 | 3/2013 | Paulsel | |

* cited by examiner

*Primary Examiner* — Hargobind S Sawhney

(74) *Attorney, Agent, or Firm* — Kilpatrick Townsend & Stockton LLP

(57) ABSTRACT

A recessed light fixture, mountable on a wall, includes a trim, heat sink, fasteners and springs. The trim has a trim frame with a trim opening for a light source. The heat sink includes an open end which opens into a cavity to house a portion of the light source, and an interior surface with an interior groove that extends around the interior surface. Each spring has a first end and an opposing second end. The first end of the springs is connected to the trim frame with a fastener. The second end of the springs is inserted through the open end of the heat sink until the second end snaps into and engages the interior groove to connect the heat sink and the trim frame. The second end is movable along the interior groove to allow rotational adjustment of the trim frame relative to the heat sink.

20 Claims, 3 Drawing Sheets

ONE PIECE LED MODULE WITH ROTATABLE FACE

RELATED CASES

The present application claims priority under 35 U.S.C. §119(e) based on U.S. Provisional Application Ser. No. 61/934,966 filed on Feb. 3, 2014, which is incorporated by reference herein in its entirety.

FIELD

The present disclosure is related to a recessed light fixture with a rotatable trim.

BACKGROUND

Recessed light fixtures are designed to be minimally visible from below a ceiling, e.g., a ceiling-board, in which they are mounted. LED light sources used for recessed lighting typically generate significant quantities of heat, requiring the use of a heat sink as part of the light fixture, to avoid overheating. The LED light source and an associated reflector, referred to as the optic, are typically mounted in the heat sink, such as a canister, or "can," type housing, so as to project light from the bottom of the heat sink. In some designs, the heat sink may be supported in a mounting frame that is suspended by bar hangers fastened between joists above the ceiling. The mounting frame is positioned so that the bottom of the heat sink passes through a ceiling opening (e.g., a cut out in the ceiling board) and is approximately flush with the bottom, exterior surface (e.g., a room-side surface) of the ceiling. A trim, which includes a trim frame (e.g., a trim ring), can be used to surround the opening in the ceiling, and mask the ceiling opening cut-out.

In some recessed light fixtures, the heat sink and the trim are distinct pieces which are separately assembled and installed onto the ceiling. For example, the heat sink is first installed onto the ceiling. The heat sink can include a lip that extends over edges around the ceiling opening against the bottom of the ceiling. The lip of the heat sink acts as a stop that does not allow the heat sink to continue to be pushed up into the ceiling cavity through the ceiling opening. The trim is thereafter installed onto the ceiling to cover the lip of the heat sink. Accordingly, the installation of these types of a recessed light fixture is complex and time consuming, and can adversely impact cosmetic aspects of the recessed light fixture when installed onto the ceiling. For example, the lip of the heat sink causes the trim to be displaced farther away from the bottom, exterior surface of the ceiling, and may require the use of a trim with sufficient thickness to mask the lip and other components of the heat sink. Further, the trim is not independently rotatable in the canister-type heat sink.

SUMMARY

To address these and other shortcomings, an improved recessed light fixture is provided, which incorporates a simple, yet effective snap-on spring assembly to connect the heat sink and the trim together while allowing rotational adjustment of the trim relative to the heat sink. The heat sink and trim can be mounted in the ceiling as a single unit or module, which simplifies installation. Furthermore, by allowing the trim and heat sink to be assembled into a single unit or module, the improved light fixture eliminates the need for a lip on the heat sink because the trim can act as a stop against the ceiling when mounting the heat sink and the trim onto the ceiling. As a consequence, the trim can be designed to further enhance cosmetic aspects of the recessed light fixture. For example, the trim can be designed with a thinner profile. The trim can also sit closer to the ceiling in comparison to known light fixtures, such as those previously discussed above, which employ a separate heat sink assembly and trim assembly.

An exemplary recessed light fixture can include a trim, heat sink, fasteners and springs. The trim has a trim frame with a trim opening for a light source, such as an LED light module or engine. The heat sink includes an open end which opens into a cavity to house a portion of the lighting source, and an interior surface with an interior groove that extends circumferentially around the interior surface. Each spring has a first end and an opposing second end. The first end of the springs is connected to the trim frame with a fastener such as a bolt or screw. The second end of the springs is inserted through the open end of the heat sink until the second end of the springs snaps into and engages the interior groove to connect the heat sink and the trim frame. The second end is movable along the interior groove to allow rotational adjustment of the trim frame relative to the heat sink. The fasteners can be detached to release the first end of the springs from the trim, which allows disengagement of the trim from the heat sink.

The heat sink along with the trim can be mounted in a ceiling opening of a room using a mounting frame, with the trim frame being flush against or proximate to an exterior surface of the ceiling. The trim frame, which can be rectangular (e.g., square), can thereafter be rotatably adjusted for cosmetic purposes to align the trim frame relative to other aspects in the room, such as the side walls. Furthermore, the adjustability of the trim frame is particularly useful for "wall wash" lighting applications, to align a plurality of wall wash trims or gimbal trims to project light onto a wall surface in a desired fashion.

BRIEF DESCRIPTION OF THE DRAWINGS

The description of the various exemplary embodiments is explained in conjunction with the appended drawings, in which.

DETAILED DESCRIPTION OF THE EXAMPLE EMBODIMENTS

The present disclosure is directed to a recessed light fixture with a rotatable trim. The recessed light fixture includes a heat sink (e.g., within or as part of a canister housing) and a trim with a trim frame, which are connected together into a single unit or module using a snap-on spring assembly to allow rotational adjustment of the trim relative to the heat sink. The heat sink and the trim are together mountable onto a wall through a wall opening via a mounting frame. The trim is rotatable to a desired orientation to align the trim with other objects in a room (e.g., room side walls, and other light fixture trims) for cosmetic purposes, or to facilitate wall washing when using a wall wash trim or gimbal trim. An example of the recessed light fixture is described in greater detail below with reference to the figures.

Figure 1:
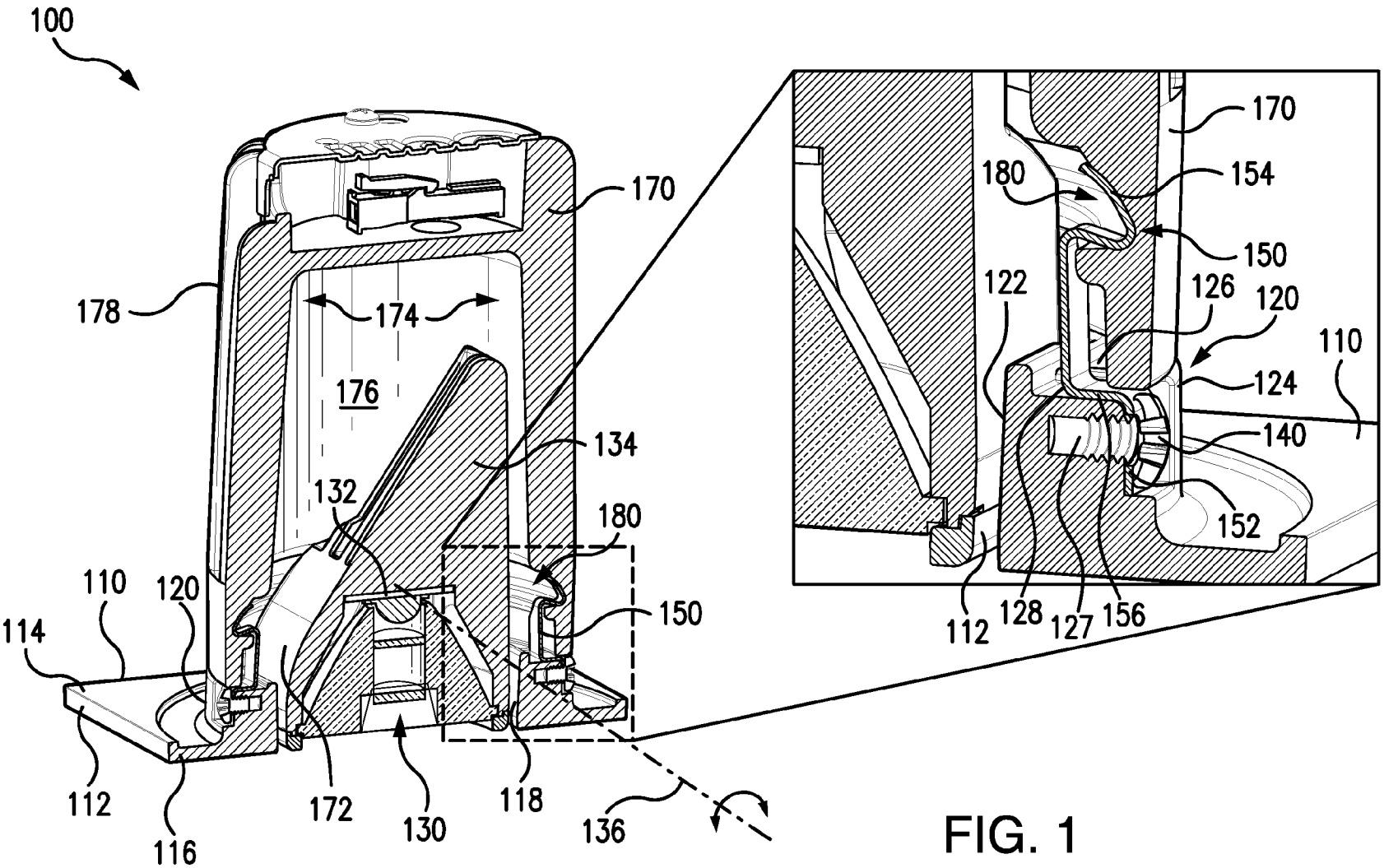
FIG. 1 illustrates a cross-sectional view of a recessed light fixture with a rotatable gimbal trim carrying a light source which is adjusted to vertical, in accordance with an exemplary embodiment of the present disclosure.

FIG. 1 illustrates a cross-sectional view of a recessed light fixture 100, which includes a trim 110, fastener(s) 140, spring(s) 150, and a heat sink 170. In general, the trim 110 is connected to one end of each of the springs 150 using a respective fastener 140, such as a bolt or screw. The other end of the springs 150 is inserted through an open end of the heat sink 170 and is snapped into an interior groove in the heat sink 170 to connect the trim 110 to the heat sink 170. The springs 150 can move along the groove 180 to allow rotational adjustment of the trim 110 relative to the heat sink 170.

Figure 2:
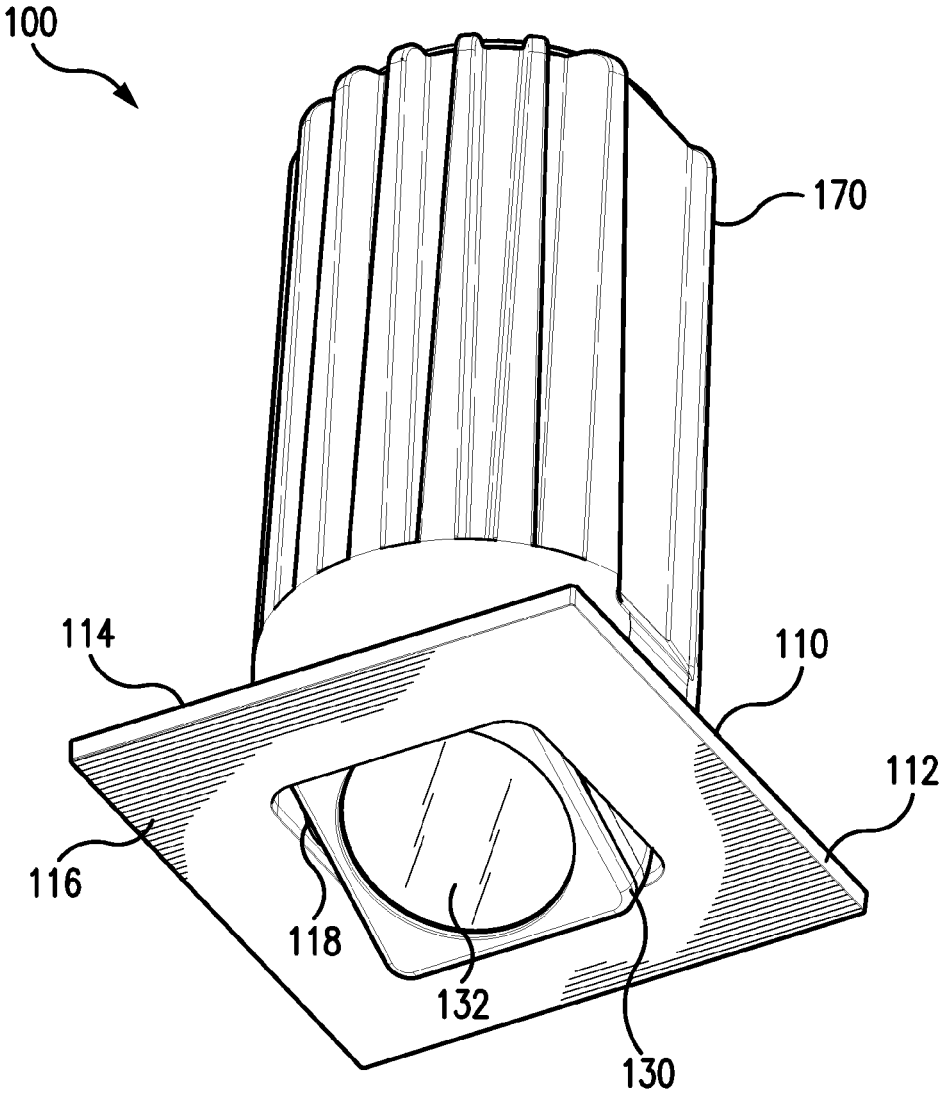
FIG. 2 illustrates another perspective view of the recessed light fixture of FIG. 1, with the light source adjusted at an acute angular position.

Specifically, in this example, the trim 110 includes a trim frame 112 with a first side 114, a second side 116 opposite the first side 114, and a trim opening 118 located in a center of the trim frame. The trim 110 is a gimbal trim, which includes a gimbal 130 with a light source 132. The gimbal 130 with the light source 132 is arranged in the trim opening 118 to pivot around an axis 136, which allows rotational adjustment to different angular positions. For example, the light source 130 is adjusted to vertical in FIG. 1, and is adjusted at an acute angular position in FIG. 2 which illustrates a perspective view of the recessed light fixture 100.

As further shown in FIG. 1, the trim frame 112 also includes a continuous raised rim 120 extending around a periphery of the trim opening 118 on the first side 114. The raised rim 120 includes an inner side surface 122, an outer side surface 124 opposite the inner side surface 122, and a top surface 126. The outer side surface 124 of the raised rim 120 can include a plurality of fastener openings 127, each of which are configured to receive one of the fasteners 140, such as a bolt or screw. In this example, a pair of fastener openings 127 is provided on the raised rim 120, with the fastener openings 127 located on opposite sides of the raised rim 120. The raised rim 120 also includes a plurality of spring channels 128 on the top surface 126. Each spring channel 128 is arranged proximate to a respective fastener opening 127, and extends inwards from the outer side surface 124 toward the inner side surface 122. The spring channel 128 is configured to provide a pathway for a portion of the spring 150 to extend into the heat sink 170, when connected to the trim frame 110. In this example, the trim frame 112 has a rectangular shape (e.g., a square), but can be configured with other shapes.

The heat sink 170 is a canister-style housing, which houses at least a portion of some of the lighting components of the light fixture 100, such as, for example, the gimbal 130 with the light source 132, inner heat sink 134, and so forth. The heat sink 170 includes an open end 172, which opens into a substantially cylindrical cavity 174 that is defined by an interior surface 176. The heat sink 170 further includes a groove 180, which extends circumferentially around the interior surface 176 at a position proximate to the open end 172. In this example, the groove 180 runs continuously around the interior surface 176; however, the groove 180 can instead comprise of a plurality of discontinuous grooves for each spring 150.

Each of the springs 150 includes a first end 152, and a second end 154 which is opposite the first end 152. The first end 152 is connectable onto the outer side surface 124 of the raised rim 120, using a respective fastener 140 which extends through the first end 152 and is secured into one of the fastener openings 127. In this example, two springs 150 are connected at opposite locations on the raised rim 120. Between the first and second ends 152 and 154, there is also a portion 156 which is configured to extend into and through a respective spring channel 128 so that the second end 154 is insertable into the cavity 174 of the heat sink 170. As shown, the second end 154 of each of the springs 150 extends away from the top surface of the raised rim 120 when the first end 152 of the springs 150 are connected to the raised rim 120.

To connect the trim 110 to the heat sink 170, the second end 154 of the springs 150 are inserted into the cavity 174 of the heat sink until they snap into and engage the interior groove 180 of the heat sink. The second end 154 of the springs is movable along the interior groove to allow rotational adjustment of the trim frame relative to the heat sink. The second end 154 can have a male element, which is configured with a shape and dimension to engage the groove 180, which is a female element. In this example, the second end 154 of the spring 150 has an angular portion that is bent at an acute angle to engage the groove 180. The interior groove 180 has cross-sectional area, which tapers as the interior groove 180 extends outwards from the interior surface 174 toward and an exterior surface 178 of the heat sink 170. When engaged in the interior groove 180 of the heat sink 170, the angular portion of the second end 154 extends into the interior groove 180 of the heat sink 170 to prevent disengagement of the heat sink 170 from the second end 154 of the spring 150.

As shown in FIG. 1, the bottom of the open end 172 of the heat sink 170 sits on or adjacent to the top surface 126 of the raised rim 120 to allow access to the fasteners 140. In this way, the trim 110 and the heat sink 170 can be disconnected by unfastening the fasteners 140 from the fastener openings 127 to release the springs 150.

Figure 3:
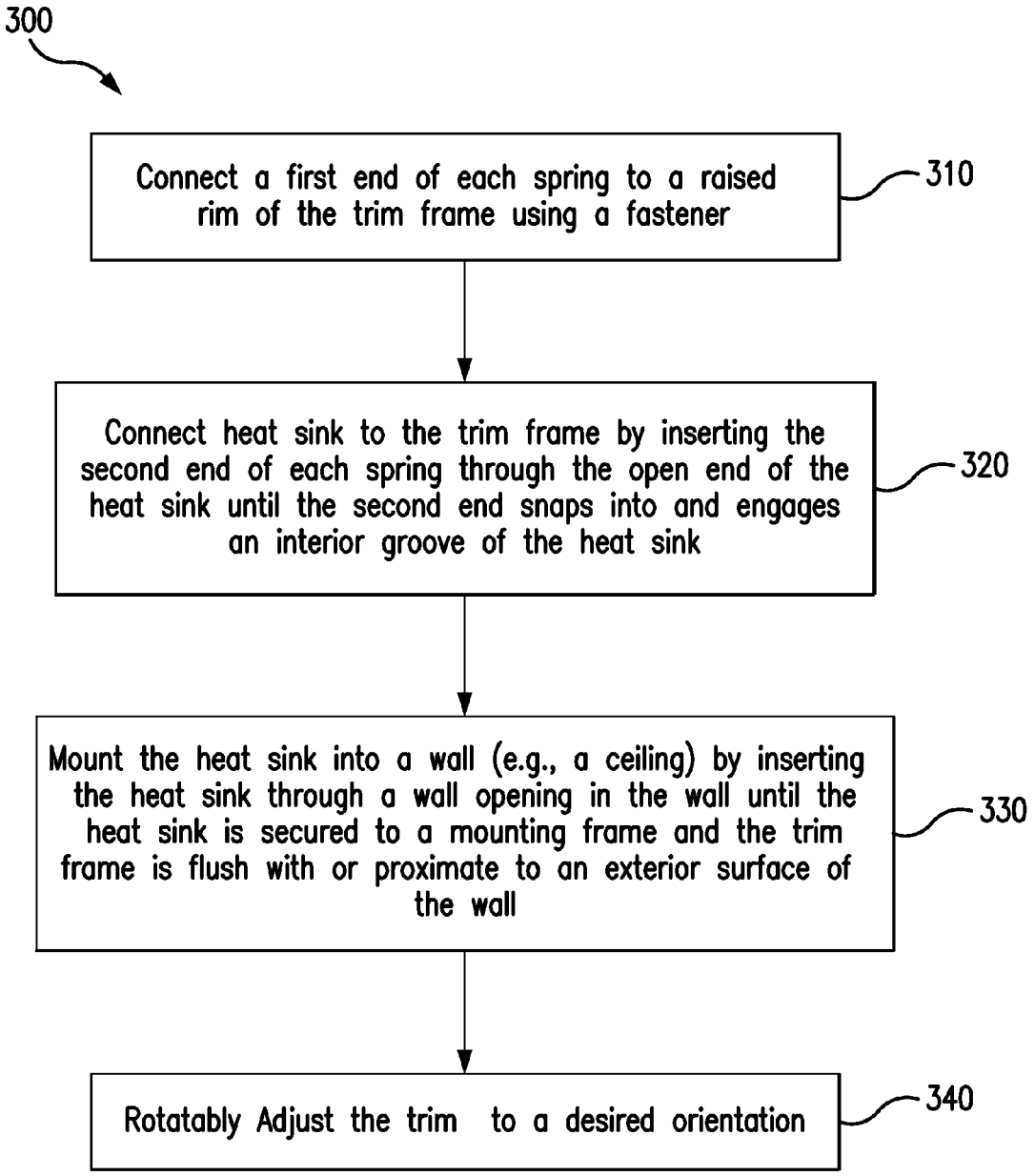
FIG. 3 is an example flow diagram of a process by which the recessed light fixture of FIG. 1 is assembled, and then mounted and adjusted on a wall.

FIG. 3 illustrates an example process 300 by which the recessed light fixture 100 is assembled into a single unit or module, and then mounted and adjusted on a wall. For the purposes of explanation, the process 300 will be described in relations to the components of the recessed light fixture 100 in FIGS. 1-2.

At reference 310, the first end 152 of each spring 150 is connected to the raised rim 120 of the trim frame 112 using a respective fastener 140. At reference 320, the heat sink 170 is connected to the trim frame 112 by inserting the second end 154 of each spring 150 through the open end 172 of the heat sink 170 until the second end 154 snaps into and engages the interior groove 180 of the heat sink 170. The second end 154 of the springs 150 initially deflect to allow insertion of the second end 154 through the open end 172 of the heat sink 170.

At reference 330, the heat sink 170 and the trim 110 is mounted onto a wall (e.g., a ceiling board) by inserting the heat sink 170 through a wall opening in the wall until the heat sink 170 is secured to a mounting frame and the trim frame 112 is flush with or proximate to a room side surface of the wall. Thereafter, at reference 340, the trim 110 can be rotatably adjusted relative to the heat sink 170 (e.g., the stationary components of the mounted heat sink 170) to a desired orientation, such as for cosmetic purposes. For example, the trim 110 can be rotated to align the trim frame with other objects in a room (e.g., trims of other light fixtures, walls or other objects) or to orient a direction of a light from the light source 132 against a wall for wall washing purposes which may entail the use of multiple recessed light fixtures 100.

The recessed light fixture, as described herein, is simply provided as an example of a light fixture with an independently adjustable trim. The spring and the interior groove of the heat sink can be designed with any suitable shape and dimension, to provide for snap-on connection of the trim and the heat sink. The interior groove can be a continuous groove, or can comprise of a plurality of discontinuous grooves on the interior surface of the heat sink for each spring.

Instead of an interior groove, the heat sink can have an exterior groove on the exterior surface. Similar to the interior groove, the exterior groove can be arranged proximate to the open end of the heat sink and extend circumferentially around the exterior surface of the heat sink. The second end of the spring can be configured to snap into and engage the exterior groove to connect the heat sink and the trim. The spring can move along the exterior groove to allow rotational adjustment of the trim relative to the heat sink.

Furthermore, instead of a groove on the heat sink, the trim can have an interior or exterior groove which extends circumferentially around the interior or exterior surface, respectively, of the trim (e.g., the raised rim of the trim frame). Each spring has a first end fastened to the heat sink via a fastener, and a second end configured to snap into and engage the groove to connect the heat sink and the trim. The spring can move along the groove to allow rotational adjustment of the trim relative to the heat sink.

Words of degree, such as "about", "substantially", and the like are used herein in the sense of "at, or nearly at, when given the manufacturing, design, and material tolerances inherent in the stated circumstances" and are used to prevent the unscrupulous infringer from unfairly taking advantage of the invention disclosure where exact or absolute figures and operational or structural relationships are stated as an aid to understanding the invention.

While particular embodiments and applications of the present disclosure have been illustrated and described, it is to be understood that the present disclosure is not limited to the precise construction and compositions disclosed herein and that various modifications, changes, and variations can be apparent from the foregoing descriptions without departing from the invention.

The invention claimed is:

1. A recessed light fixture, mountable on a wall, comprising:

a trim including a trim frame having a trim opening for a recessed light source;

a heat sink including a cavity to house a portion of the recessed light source, an open end which opens into the cavity, and a groove on a surface of the heat sink;

fasteners; and springs each having a first end and a second end opposite the first end, the first end being connectable to the trim frame via a respective fastener from the fasteners, the second end to snap into and engage the groove of the heat sink to connect the heat sink to the trim frame, the second end being movable along the groove to allow rotational adjustment of the trim frame relative to the heat sink.

2. The recessed light fixture of claim 1, wherein the trim frame includes a raised rim extending around a periphery of the trim opening, the first end of each spring being connectable to the raised rim using a respective fastener from the fasteners.

3. The recessed light fixture of claim 2, wherein the raised rim has an outer side surface, an opposite inner side surface and a top surface, the first end of each spring being connectable to the outer side surface of the raised rim using a respective fastener from the fasteners.

4. The recessed light fixture of clam 3, wherein the outer side surface of the raised rim includes fastener openings, each of the fastener openings to receive a respective fastener from the fasteners.

5. The recessed light fixture of claim 3, wherein the raised rim includes spring channels on the top surface which extend inwards from the outer side surface toward the inner side surface, each of the spring channels to receive a portion of the one of the springs between the first end and the second end.

6. The recessed light fixture of claim 5, wherein the second end of each of the springs extends away from the top surface of the raised rim when the first end of the springs are connected to the rim.

7. The recessed light fixture of claim 1, wherein the trim frame is rectangular.

8. The recessed light fixture of claim 1, wherein the cavity of the heat sink is substantially cylindrical.

9. The recessed light fixture of claim 1, wherein the surface of the heat sink is an interior surface, and the groove is an interior groove on the interior surface.

10. The recessed light fixture of claim 9, wherein the interior groove extends circumferentially around the interior surface of the heat sink.

11. The recessed light fixture of claim 9, wherein the interior groove is proximate the open end of the heat sink.

12. The recessed light fixture of claim 9, wherein the interior groove has a cross-sectional area which tapers as the interior groove extends outwards from the interior surface toward an exterior surface of the heat sink.

13. The recessed light fixture of claim 9, wherein the second end of the springs includes an angular portion bent at an acute angle which when engaged in the interior groove of the heat sink extends into the interior groove of the heat sink to prevent disengagement of the heat sink from the second end of the spring.

14. The recessed light fixture of claim 9, wherein the springs are connected to the trim frame, the second end of the springs initially deflecting to allow insertion of the second end through the open end of the heat sink until the second end snaps into and engages the interior groove of the heat sink.

15. The recessed light fixture of claim 14, wherein each of the fasteners is detachable from the first end of the springs and the trim frame to allow disengagement of the trim frame from the heat sink.

16. The recessed light fixture of claim 1, wherein the trim further includes a gimbal movably mounted in the trim opening.

17. A method of mounting a recessed light fixture onto a wall comprising:

providing a trim including a trim frame having a trim opening for a recessed light source;

providing a heat sink including a cavity to house a portion of the recessed light source, an open end which opens into the cavity, and an interior surface with an interior groove;

providing fasteners;

providing springs each having a first end and a second end opposite the first end;

connecting the first end of each of the springs to the trim frame via a respective fastener from the fasteners; and inserting the second end of the springs through the open end of the heat sink until the second end of the springs snaps into and engages an interior groove of the heat sink to connect the heat sink and the trim frame, the second end being movable along the interior groove to allow rotational adjustment of the trim frame relative to the heat sink.

18. The method of claim 17, further comprising:

mounting the heat sink in a wall opening in the wall with the trim frame being flush with or proximate to an exterior surface of the wall; and rotatably adjusting the trim frame to a desired orientation.

19. The method of claim 17, wherein the interior groove extends circumferentially around the interior surface of the heat sink.

20. A recessed light fixture, mountable on a wall, comprising:

a trim including a trim frame having a trim opening for a recessed light source;

a heat sink including a cavity to house a portion of the recessed light source, an open end which opens into the cavity;

fasteners; and springs each having a first end and a second end opposite the first end, the first end being connectable to one of the trim frame and the heat sink via a respective fastener from the fasteners, the second end to snap into and engage a groove of the other of the trim frame and the heat sink to connect the heat sink to the trim frame, the second end being movable along the groove to allow rotational adjustment of the trim frame relative to the heat sink.

* * * * *